US006848635B2

(12) United States Patent
Xu

(10) Patent No.: US 6,848,635 B2
(45) Date of Patent: Feb. 1, 2005

(54) FUEL INJECTOR NOZZLE ASSEMBLY WITH INDUCED TURBULENCE

(75) Inventor: Min Xu, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 280 days.

(21) Appl. No.: 10/062,075

(22) Filed: Jan. 31, 2002

(65) Prior Publication Data

US 2003/0141387 A1 Jul. 31, 2003

(51) Int. Cl.[7] ..... F02M 61/00

(52) U.S. Cl. ..... 239/533.12; 239/502; 239/522; 239/596; 239/533.14

(58) Field of Search ..... 239/533.12, 502, 239/522, 553, 596, 533.14

(56) References Cited

U.S. PATENT DOCUMENTS

| | | | | |
|---|---|---|---|---|
| 4,018,387 A | | 4/1977 | Erb et al. | |
| 4,389,986 A | | 6/1983 | Tanasawa | |
| 4,826,131 A | * | 5/1989 | Mikkor | 251/129.17 |
| 4,907,748 A | | 3/1990 | Gardner et al. | |
| 5,058,548 A | | 10/1991 | Morikawa et al. | |
| 5,237,975 A | | 8/1993 | Betki et al. | |
| 5,335,635 A | | 8/1994 | Kadoi et al. | |
| 5,383,597 A | | 1/1995 | Sooriakumar et al. | |
| 5,398,655 A | | 3/1995 | Tuckey | |
| 5,449,114 A | | 9/1995 | Wells et al. | |
| 5,484,108 A | | 1/1996 | Nally | |
| 5,662,277 A | * | 9/1997 | Taubitz et al. | 239/585.4 |
| 5,673,670 A | | 10/1997 | Powell et al. | |
| 5,762,272 A | | 6/1998 | Tani et al. | |
| 5,766,441 A | * | 6/1998 | Arndt et al. | 205/170 |
| 5,911,366 A | | 6/1999 | Maier et al. | |
| 5,941,207 A | | 8/1999 | Anderson et al. | |
| 6,089,473 A | | 7/2000 | Keim | |
| 6,227,164 B1 | | 5/2001 | Miller | |

FOREIGN PATENT DOCUMENTS

| | | |
|---|---|---|
| WO | WO 95/04881 | 2/1995 |

* cited by examiner

*Primary Examiner*—Dinh Q. Nguyen
(74) *Attorney, Agent, or Firm*—Brinks Hofer Gilson & Lione

(57) ABSTRACT

A fuel injector nozzle assembly includes an injector body including a valve seat with a supply passage through which fuel flows generally along a supply axis. A nozzle plate is mounted onto the valve seat and includes a plurality of orifice holes therein through which fuel flows. A turbulence cavity is defined by the nozzle plate and the valve seat wherein fuel flows into the turbulence cavity through the supply passage and out from the turbulence cavity through the plurality of orifice holes. A plurality of obstructions are located within the turbulence cavity directly in front of the orifice holes and are adapted to create turbulence eddies within the flow entering the orifice holes.

14 Claims, 5 Drawing Sheets

FUEL INJECTOR NOZZLE ASSEMBLY WITH INDUCED TURBULENCE

TECHNICAL FIELD

The present invention generally relates to a fuel injector nozzle for providing fine atomization of fuel expelled into an internal combustion engine.

BACKGROUND

Stringent emission standards for internal combustion engines suggest the use of advanced fuel metering techniques that provide extremely small fuel droplets. The fine atomization of the fuel not only improves emission quality of the exhaust, but also improves the cold start capabilities, fuel consumption, and performance. Traditionally, fine atomization of the fuel is achieved by injecting the fuel at high pressures. However, this requires the use of a secondary high pressure fuel pump, which causes cost and packaging concerns. Additionally, injecting the fuel at high pressure causes the fuel to propagate into the piston cylinder causing wall wetting and piston wetting concerns. Traditional low pressure direct injection systems do not present the wall wetting and piston wetting problems associated with high pressure systems, however, current low pressure systems do not provide optimum fuel atomization. Therefore, there is a need in the industry for a fuel injector nozzle that will provide fine atomization of the fuel at low fuel flow pressures.

DETAILED DESCRIPTION OF THE PREFERRED EMBODIMENTS

The following description of the preferred embodiments of the invention is not intended to limit the scope of the invention to these preferred embodiments, but rather to enable any person skilled in the art to make and use the invention. The present invention is related to United States Patent application Ser. No. 10/043,367 entitled "Fuel Injector Nozzle Assembly", filed Jan. 9, 2002, which is assigned to the assignee of the present application and is hereby incorporated by reference into this application.

Figure 1:
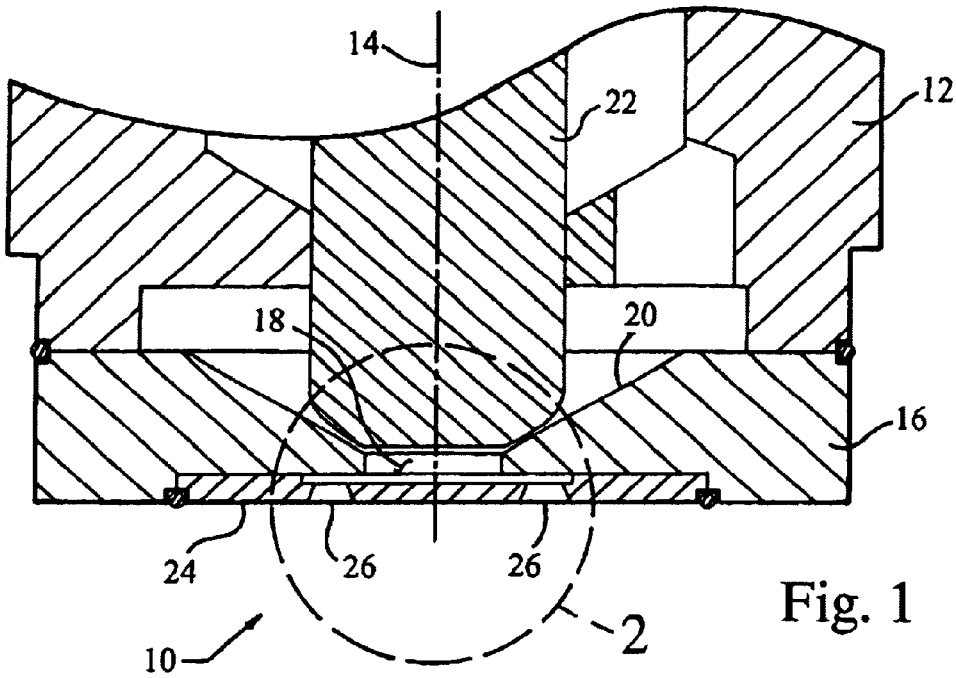
FIG. 1 is a cross sectional view of a first preferred embodiment of a fuel injector nozzle assembly of the present invention shown in a closed state.
Figure 2:
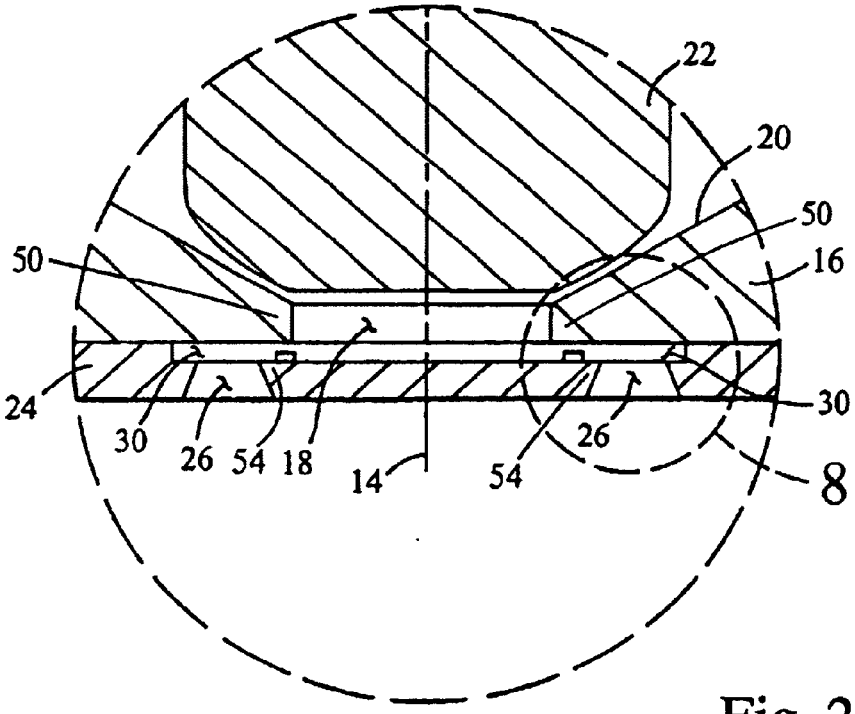
FIG. 2 is a detailed view of a portion of FIG. 1 shown in an open state.
Figure 3:
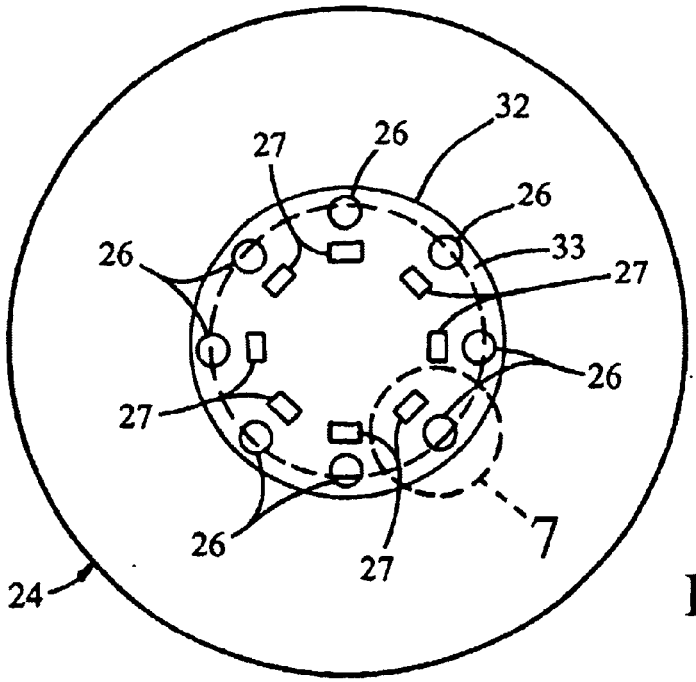
FIG. 3 is a top view of a nozzle plate of the first preferred embodiment where the orifice holes are in a circular pattern.

Referring to FIGS. 1–3, a fuel injector nozzle assembly of the preferred embodiment of the present invention is shown generally at 10. The fuel injector nozzle assembly 10 includes an injector body 12 which defines a supply axis 14 through which fuel flows. A distal end of the injector body 12 defines a valve seat 16. The valve seat 16 has a supply passage 18 through which fuel flows outward from the injector body 12. An upper surface 20 of the valve seat 16 is adapted to engage a valve 22 to selectively seal the supply passage 18 to block the flow of fuel from the injector body 12.

A nozzle plate 24 is mounted onto the valve seat 16 and includes a plurality of orifice holes 26 extending therethrough, which are adapted to allow fuel to flow outward. In the preferred embodiment, the nozzle plate 24 is made from metal, and is welded onto the valve seat 16. Specifically, the nozzle plate 24 is preferably made from stainless steel, and is attached to the valve seat 16 by laser welding.

Referring again to FIG. 2, the valve seat 16 includes a first edge protrusion 50 protruding into the fuel flow. The first edge protrusion 50 generates a vortex turbulence in the fuel flowing adjacent thereto. Preferably, the first edge protrusion 50 comprises an edge of a circumferential lip section of the valve seat 16 which defines a generally circular lower neck section of the supply passage 18 therein.

Figure 8:
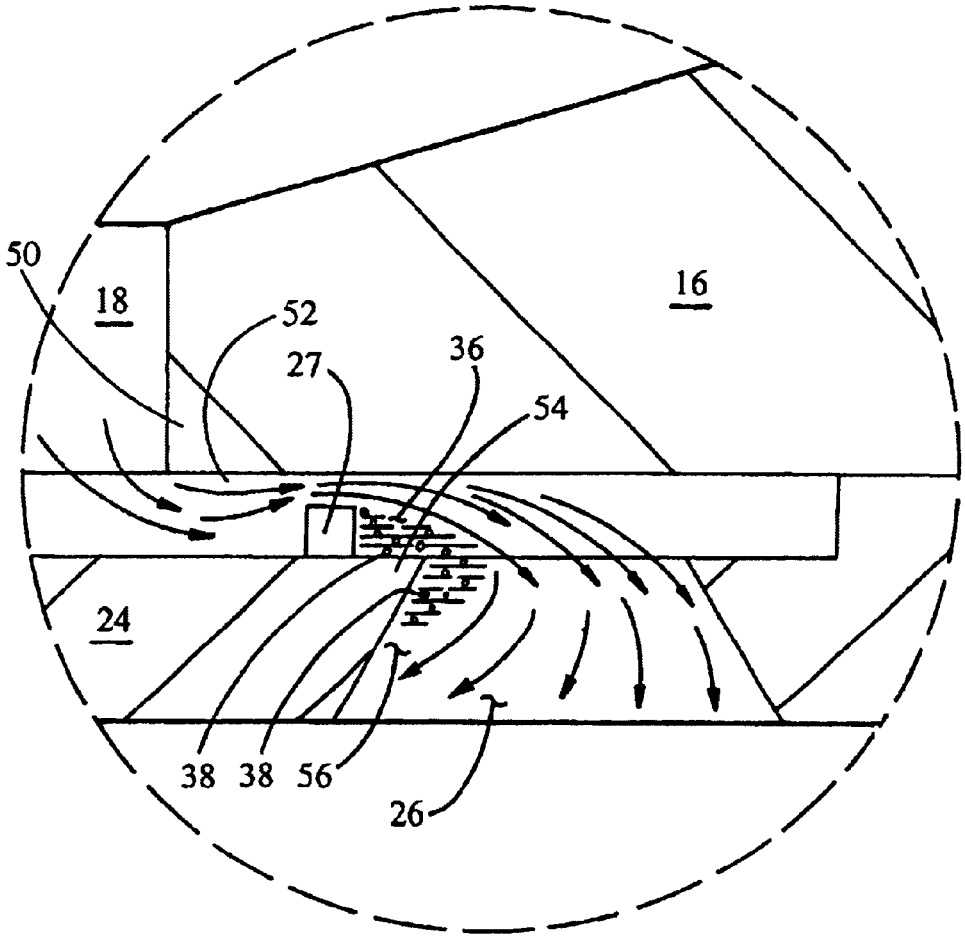
FIG. 8 is a detailed view of FIG. 2 showing the fuel flow and wake produced by the obstruction in front of the orifice hole.

Referring to FIG. 8, the first edge protrusion 50 causes the fuel flow to separate from the upper wall of the turbulence cavity 30 forming a separation boundary 52. The separation boundary is formed because the flow is bending very sharply around the first edge protrusion 50. The flow cannot follow the sharp bend of the first edge protrusion 50, and therefore separates from the upper wall of the turbulence cavity 30. Within the separation boundary 52, many small eddies are formed which are entrained into the mein fuel flow, thereby causing additional turbulence within the main fuel flow.

The separation caused by the first edge protrusion 50 is immediately upstream of the orifice holes 26, therefore, the eddies that are formed within the boundary separation 52 adjacent the first edge protrusion 50 are entrained directly into the main flow that is entering the orifice holes 26, thereby creating additional turbulence within the flow to improve the atomization of the fuel passing through the orifice holes 26.

The proximity of the first edge protrusion 50 to the orifice holes 26 causes the eddies formed within the separation boundary 52 to be entrained within the fuel flowing into the orifice holes 26. This additional turbulence within the main fuel flow causes rapid breakup of the liquid jet which contributes to smaller droplet size within the fuel spray, This is what allows the spray and droplet size of the fuel to be controlled. Rather than using turbulence kinetic energy from a high pressure flow, the present invention uses turbulence from the eddies which are created by the flow separation at the first edge protrusion 50 and are entrained within the main fuel flow.

The nozzle plate 24 also includes a second edge protrusion 54 protruding into the fuel flow. The second edge protrusion 54 generates a vortex turbulence in the fuel flowing adjacent thereto. The second edge protrusion 54 causes the fuel flaw to separate from the nozzle plate 24 forming a second separation boundary 56. The second separation boundary 56 is formed because the flow is forced upward very sharply as the flow approaches the orifice holes 26. The flow is then bent very sharply around the second edge protrusion 54 prior to entering the orifice holes 26. The flow cannot follow the sharp bend of the second edge protrusion 54, and therefore separates from the nozzle plate 24. Within the second separation boundary 56, many small eddies are formed which are entrained into the main fuel flow, thereby causing additional turbulence within the main fuel flow.

The nozzle plate 24 includes a plurality of obstructions 27 protruding into the fuel flow immediately in front of the orifice holes 26, such that the fuel flowing toward the orifice holes 26 will reach the obstructions 27 prior to reaching the orifice holes 26. The obstructions 27 are adapted to generate turbulence eddies 38 within the flow immediately in front of the orifice holes 26 such that the turbulence eddies 38 are entrained into the flow through the orifice holes 26.

Preferably, the orifice holes 26 within the nozzle plate 24 are round and conical, extending downward such that the narrow end of the conical orifice holes 26 are directed upward toward the valve seat 16. The fuel flowing through the orifice holes 26 can freely expand inside the conical orifice hole 26 without suppression. Due to the rapid flow expansion at the sharp edge of the orifice holes 26, cavitation and separation occurs right below the sharp edge, which greatly induces external disturbance on the freshly generated jet surface to prevent relamination of the flow by the walls of the orifice holes 26 and enhancing the atomization of the fuel.

Figure 4:
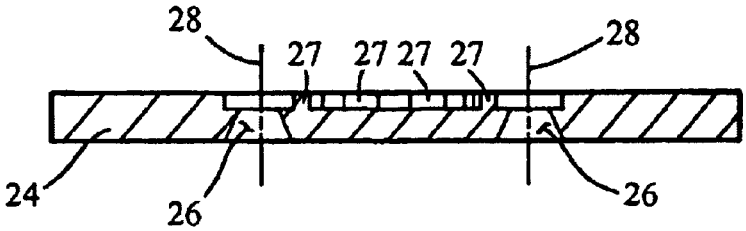
FIG. 4 is a cross-sectional view of the nozzle plate shown in FIG. 3 taken along line A—A where a centerline of the orifice holes is parallel to the supply axis.
Figure 5:
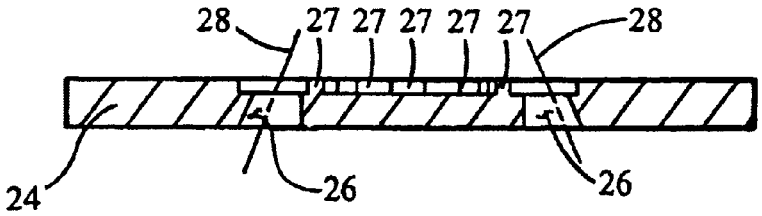
FIG. 5 is a cross-sectional view of the nozzle plate shown in FIG. 3 taken along line A—A where the centerline of the orifice holes is skewed with respect to the supply axis.

The cone angle of the conical orifice holes 26 can be adjusted to change the spray angle of the fuel. Referring to FIG. 4, the conical orifice holes 26 include a centerline 28 which is parallel to the supply axis 14. However, the centerline 28 of the conical orifice holes 26 can also be angled relative to the supply axis 14 as shown in FIG. 5 to meet particular packaging and targeting requirements of the injector assembly 10. In conventional nozzles, alterations to the spray angle, and skewing the spray relative to the axis of the injector will typically have a corresponding affect on the spray quality. The nozzle assembly 10 of the present invention can be tailored for spray angle and skew relative to the injector axis 14 with minimal corresponding affect on the spray quality, by orienting the conical orifice holes 26 at an angle relative to the injector axis 14.

The nozzle plate 24 and the valve seat 16 define a turbulence cavity 30. More specifically, the turbulence cavity 30 is defined by an annular section extending between the valve seat 16 and the nozzle plate 24 such that fuel flows generally from the supply passage 18 into the turbulence cavity 30 and outward from the turbulence cavity 30 through the orifice holes 26 in the nozzle plate 24. Preferably the nozzle plate 24 includes a recess 32 formed within a top surface of the nozzle plate 24. In the preferred embodiment, the recess 32 is circular in shape, wherein when the nozzle plate 24 is mounted onto the valve seat 16 the turbulence cavity 30 is defined by the recess 32 and the valve seat 16. It is to be understood that the recess 32 could also be other shapes such as an oval or ellipse shaped depending upon the spray characteristics required for the particular application.

Figure 6:
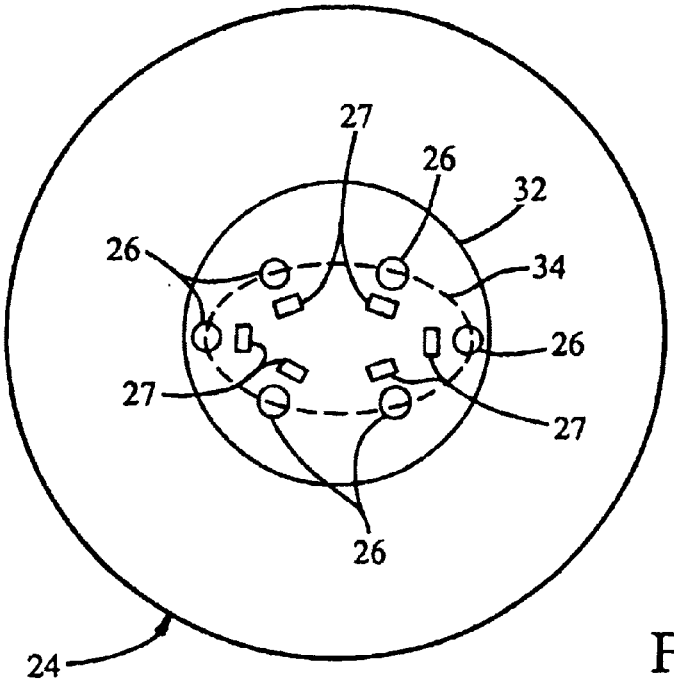
FIG. 6 is a top view of the nozzle plate of the first preferred embodiment where the orifice holes are in an oval pattern.

In the preferred embodiment the plurality of orifice holes 26 are evenly distributed along a circular pattern 33 within the recess 32, as shown in FIG. 3. The circular pattern 33 on which the orifice holes 26 are distributed is preferably concentric with the recess 32, but could also be offset from the center of the recess 32. The circular pattern 33 has a diameter which is less than the recess 32 such that the orifice holes 26 are in fluid communication with the turbulence cavity 30. Referring to FIG. 6, the orifice holes 26 could also be distributed along an oval pattern 34. It is to be understood that the pattern of the orifice holes 26 could be any suitable pattern and is to be determined based upon the required spray characteristics of the particular application.

The number of orifice holes 26 depends upon the design characteristics of the injector assembly 10. By changing the number of orifice holes 26 within the nozzle plate 24 the flow rate of the injector assembly 10 can be adjusted without affecting the spray pattern or droplet size of the fuel. In the past, in order to adjust the flow rate, the pressure would be increased or decreased, or the size of the orifice adjusted, either of which would lead to altered spray characteristics of the fuel. The present invention allows the flow rate of the injector assembly 10 to be adjusted by selecting an appropriate number of orifice holes 26 without a corresponding deterioration of the spray. By including additional orifice holes 26 with the same dimensions, the total amount of fuel flowing is increased. However, each individual orifice hole 26 will produce identical spray characteristics, thereby maintaining the spray characteristics of the overall flow.

Figure 7:
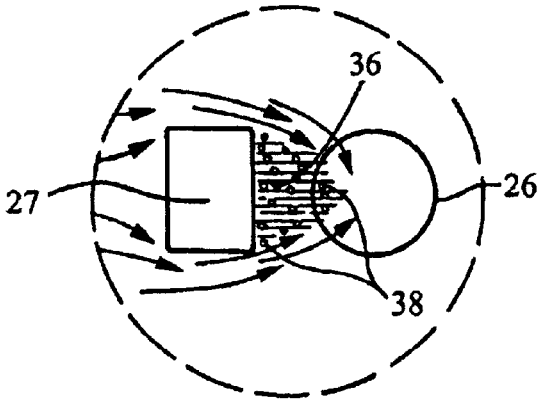
FIG. 7 is a detailed view of FIG. 3 showing the fuel flow and wake produced by the obstruction in front of the orifice hole.

In a first preferred embodiment, the obstructions 27 are placed immediately in front of the orifice holes 26 such that the flow will reach the obstructions 27 prior to reaching the orifice hole whereby a turbulence wake 36 is formed behind the obstructions 27 and immediately in front of the orifice holes 26. Referring to FIG. 3, the obstructions 27 are preferably square or rectangular blocks placed immediately in front of the orifice holes 26. One obstruction block 27 is placed in front of each orifice hole 26. Referring to FIG. 7, the fuel flowing around the obstructions 27 typically cannot follow the sharp bend of the back side of the obstruction 27, and therefore a turbulence wake 36 is formed immediately behind the obstructions 27. The turbulence wake 36 extends outward until the fuel flow fills in and merges with the fuel flowing around the other side of the obstruction 27. Due to the proximity of the orifice holes 26 to the obstructions 27, the turbulence wake 36 extends over the orifice holes 26.

Within the turbulence wake 36, many small turbulence eddies 38 are formed which are entrained into the main fuel flow. Since the turbulence wake 36 extends outward over the orifice holes 26, these turbulence eddies 38 are entrained directly into the fuel flowing outward through the orifice holes 26. The turbulence eddies 38 contribute to rapid liquid break-up and atomization as the fuel flows through the conical orifice holes 26, which contributes to smaller droplet size within the fuel spray.

The obstructions 27 of the first preferred embodiment can extend from a bottom surface of the turbulence cavity 30 to the valve seat 16, such that the fuel flow must pass to either side of the obstructions 27. Alternatively, the obstructions 27 of the first preferred embodiment can extend upward only partially to the valve seat 16, thereby allowing the fuel to flow over the top of the obstructions 27 as well as to either side as shown in FIG. 8.

Figure 9:
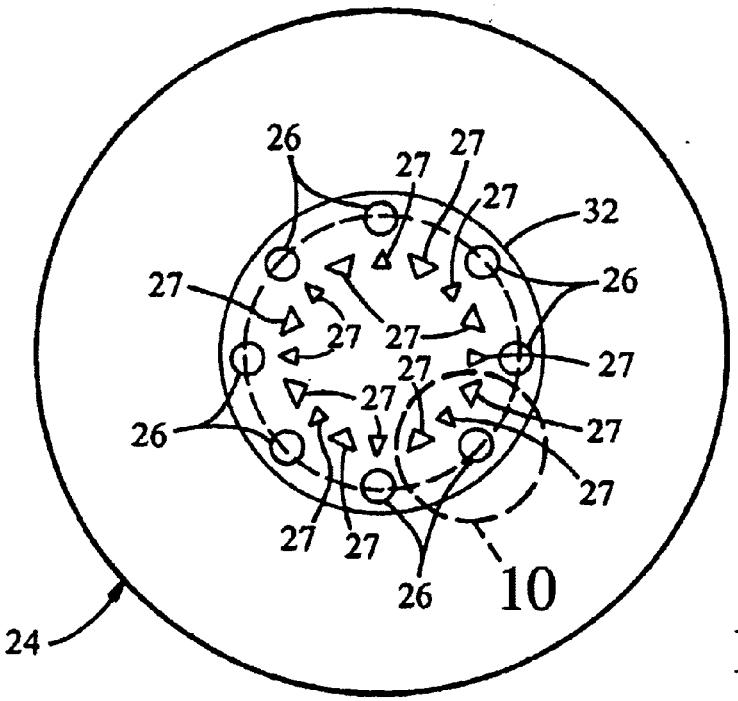
FIG. 9 is a top view of a nozzle plate of a second preferred embodiment.
Figure 10:
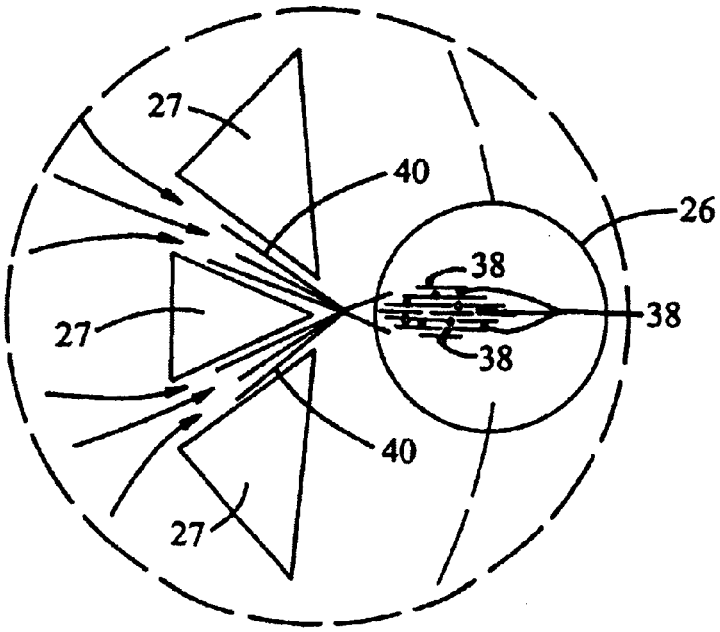
FIG. 10 is a detailed view of FIG. 9 showing the fuel flow and turbulence eddies created by the obstructions in front of the orifice hole.

Referring to FIG. 9, in a second preferred embodiment, the obstructions 27 are the height of the turbulence cavity 30 and extend up from the bottom surface of the turbulence cavity 30 to the valve seat 16. The fuel flowing from the supply passage 18 through the turbulence cavity 30 is forced to flow to either side of the obstructions 27. In the second preferred embodiment, the obstructions 27 are positioned radially around the turbulence cavity 30 immediately in front of the orifice holes 30. Preferably, the obstructions 27 are triangular shaped blocks which are oriented such that the fuel flow is separated into a plurality of individual flows 40. The individual flows 40 are directed such that adjacent flows collide with one another immediately in front of one of the orifice holes 26, as shown in FIG. 10.

As the individual flows 40 collide with one another, the turbulence within each of the colliding flows 40 is increased significantly, such that turbulence eddies 38 are formed therein. The individual flows 40 are arranged to collide immediately in front of the orifice holes 26 such that the newly created turbulence eddies 38 will be drawn directly into the flow through the orifice holes 26. The turbulence eddies 38 contribute to rapid liquid break-up and atomization as the fuel flows through the conical orifice holes 26, which contributes to smaller droplet size within the fuel spray.

In both the first and second preferred embodiments, the additional turbulence within the main fuel flow causes rapid breakup of the liquid jet, which contributes to smaller droplet size within the fuel spray. This allows the spray and droplet size of the fuel to be controlled. Rather than using turbulence energy generated by high pressure flow, the present invention uses turbulence within the turbulence eddies 38 which are created by the obstructions 27 and are entrained within the main fuel flow.

The foregoing discussion discloses and describes two preferred embodiments of the invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology which has been used is intended to be in the nature of words of description rather than of limitation.

We claim:

1. A fuel injector nozzle assembly comprising;

an injector body including a valve seat with a supply passage through which fuel flows generally along a supply axis, said valve seat presenting an upper surface adapted to engage a valve to seal said supply passage;

a nozzle plate mounted onto said valve seat including a plurality of round conical orifice holes therein through which fuel flows;

said valve seat further including a first edge protrusion, protruding into the fuel flow for generating a first separation of the fuel flow, thereby creating a plurality of small eddies which are entrained within the fuel flowing adjacent thereto, said first edge protrusion defined by a circumferential lip section of said valve seat defining said supply passage therein;

a turbulence cavity defined by said nozzle plate and said valve seat wherein fuel flows into said turbulence cavity through said supply passage and out from said turbulence cavity through said plurality of orifice holes;

said nozzle plate further including a second edge protrusion protruding into the fuel flow for generating a second separation of the fuel flow, thereby creating a plurality of small eddies which are entrained within the fuel flowing adjacent thereto; and a plurality of obstructions located directly in front of said orifice holes and being adapted to create turbulence eddies within the flow entering said orifice holes.

2. The fuel injector nozzle assembly of claim 1 wherein said obstructions extend from said nozzle plate to said valve seat such that the fuel flowing from said supply passage must flow to either side of said obstructions.

3. The fuel injector nozzle assembly of claim 2 wherein said obstructions are arranged such that the fuel flowing through said turbulence cavity is divided into a plurality of individual flows whereby adjacent individual flows are directed to collide with one another immediately in front of one of said orifice holes, thereby creating a plurality of small turbulence eddies which are entrained into the fuel flowing through said orifice holes.

4. The fuel injector nozzle assembly of claim 1 wherein said obstructions are arranged to create a turbulence wake immediately in front of said orifice holes, thereby creating a plurality of small turbulence eddies which are entrained into the fuel flowing through said orifice holes.

5. The fuel injector nozzle assembly of claim 4 wherein said obstructions are shorter than the height of said turbulence cavity such that the fuel flowing from said supply passage can pass to either side and over said obstructions.

6. The fuel injector nozzle assembly of claim 1 wherein said nozzle plate includes a recess formed within a top surface of said nozzle plate.

7. The fuel injector nozzle assembly of claim 6 wherein said recess is circular in shape.

8. The fuel injector nozzle assembly of claim 7 wherein said plurality of orifice holes are evenly distributed along a circular pattern, said circular pattern having a diameter smaller than said first recess.

9. The fuel injector nozzle assembly of claim 8 wherein said circular pattern is concentric with said first recess.

10. The fuel injector nozzle assembly of claim 6 wherein said plurality of orifice holes are evenly distributed along an oval pattern within said first recess.

11. The fuel injector nozzle assembly of claim 1 wherein said orifice holes are round.

12. The fuel injector nozzle assembly of claim 11 wherein said orifice holes are conical in shape.

13. The fuel injector nozzle assembly of claim 11 wherein each of said orifice holes includes a centerline that is parallel to said supply axis.

14. The fuel injector nozzle assembly of claim 11 wherein each of said orifice holes includes a centerline that is angled relative to said supply axis.

* * * * *